US007584699B2

(12) United States Patent
Ford

(10) Patent No.: US 7,584,699 B2
(45) Date of Patent: Sep. 8, 2009

(54) METHOD FOR CORRECTING PRINT REPEAT LENGTH VARIABILITY IN PRINTED EXTENSIBLE MATERIALS AND PRODUCT

(75) Inventor: Jerry W. Ford, Alexandria, KY (US)

(73) Assignee: Clopay Plastic Products Company, Inc., Mason, OH (US)

( * ) Notice: Subject to any disclaimer, the term of this patent is extended or adjusted under 35 U.S.C. 154(b) by 561 days.

(21) Appl. No.: 11/179,040

(22) Filed: Jul. 11, 2005

(65) Prior Publication Data

US 2006/0016359 A1 Jan. 26, 2006

Related U.S. Application Data

(60) Provisional application No. 60/586,582, filed on Jul. 10, 2004.

(51) Int. Cl.

| | |
|---|---|
| ***B41F 1/54*** | (2006.01) |
| ***B41F 1/66*** | (2006.01) |
| ***B41L 5/12*** | (2006.01) |
| ***B41L 39/00*** | (2006.01) |
| ***B41L 47/56*** | (2006.01) |
| ***B41F 1/34*** | (2006.01) |
| ***B41F 21/12*** | (2006.01) |
| ***B41F 21/14*** | (2006.01) |
| ***B41L 1/02*** | (2006.01) |

(52) U.S. Cl. ..... 101/484; 101/485

(58) Field of Classification Search ..... 101/483, 101/484, 485

See application file for complete search history.

(56) References Cited

U.S. PATENT DOCUMENTS

| | | | | |
|---|---|---|---|---|
| 3,525,872 | A | 8/1970 | Schneider | |
| 3,599,389 | A | 8/1971 | Hartman | |
| 3,701,464 | A | 10/1972 | Crum | |
| 4,383,880 | A | 5/1983 | Geurtsen et al. | |
| 4,533,269 | A | 8/1985 | Pou et al. | |
| 4,601,239 | A | 7/1986 | Sillars | |
| 4,680,205 | A | 7/1987 | Lerner | |
| 4,719,575 | A | 1/1988 | Gnuechtel | |
| 4,909,879 | A | 3/1990 | Ball | |
| 4,926,048 | A | 5/1990 | Lerner et al. | |
| 4,945,252 | A | 7/1990 | Lerner et al. | |
| 5,279,858 | A | 1/1994 | Suzuki et al. | |
| RE35,067 | E * | 10/1995 | Bauknecht | 493/11 |
| 5,458,590 | A | 10/1995 | Schleinz et al. | |
| 5,501,149 | A | 3/1996 | Schleinz et al. | |
| 5,503,076 | A | 4/1996 | Yeo | |

(Continued)

FOREIGN PATENT DOCUMENTS

| | | |
|---|---|---|
| WO | WO 0060916 | 10/2000 |

*Primary Examiner*—Judy Nguyen
*Assistant Examiner*—Leo T Hinze
(74) *Attorney, Agent, or Firm*—Dinsmore & Shohl LLP

(57) ABSTRACT

A method of printing a repeating pattern on a web of an extensible material by providing a web of an extensible material, determining an adjusted print repeat length profile for a repeating pattern to be printed on the web of material; and printing a repeating pattern on a surface of the extensible material, the repeating pattern comprising printed indicia which is repeated along the length of the web, such that the print repeat length of the printed indicia varies along the length of the web in accordance with the adjusted print repeat length profile.

11 Claims, 11 Drawing Sheets

U.S. PATENT DOCUMENTS 5,520,112 A 5/1996 Schleinz et al.
5,526,748 A 6/1996 Schleinz et al.
5,562,037 A 10/1996 Schleinz et al.
5,566,616 A 10/1996 Schleinz et al.
5,572,433 A 11/1996 Falconer et al.
5,597,642 A 1/1997 Schleinz et al.
5,612,118 A 3/1997 Schleinz et al.
5,695,855 A 12/1997 Yeo et al.
5,714,197 A 2/1998 Suzuki et al.
5,743,184 A * 4/1998 Skudrzyk ..... 101/181
5,766,389 A 6/1998 Brandon et al.
5,818,719 A 10/1998 Brandon et al.
5,820,007 A 10/1998 Crowley
5,930,139 A 7/1999 Chapdelaine et al.
5,932,039 A 8/1999 Popp et al.
5,964,970 A 10/1999 Woolwine et al.
5,980,087 A 11/1999 Brandon et al.
6,020,047 A 2/2000 Everhart
6,033,502 A 3/2000 Coenen et al.
6,092,002 A 7/2000 Kastman et al.
6,231,715 B1 5/2001 Schleinz et al.
6,245,168 B1 6/2001 Coenen et al.
2003/0129907 A1 * 7/2003 Shacklett et al. ..... 442/374
2005/0153100 A1 * 7/2005 Zoller et al. ..... 428/131

* cited by examiner

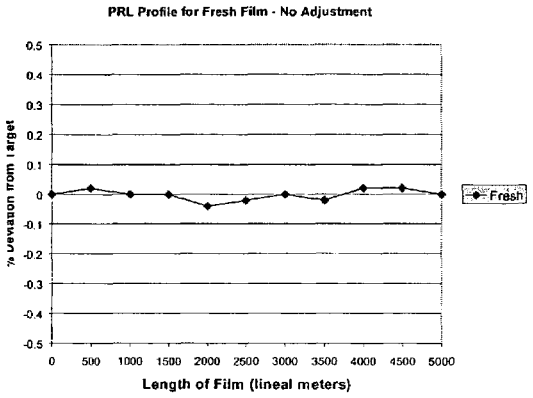
Figure 3a
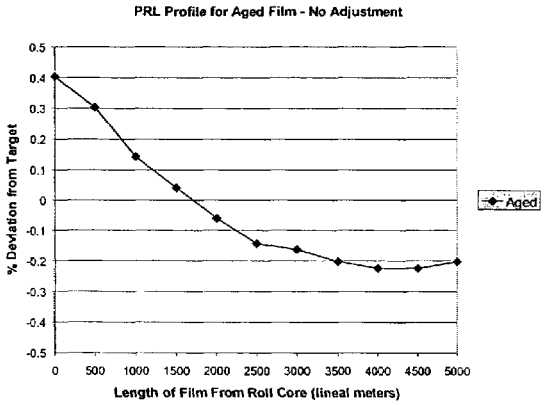
Figure 3b
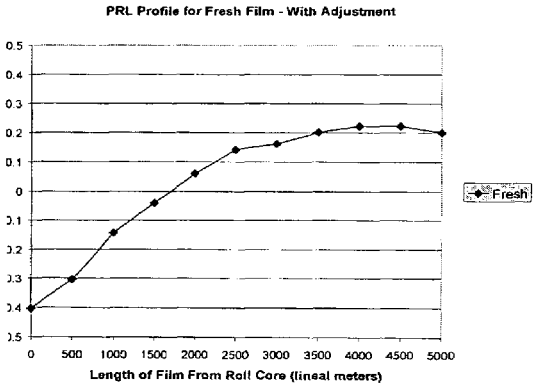
Figure 3c
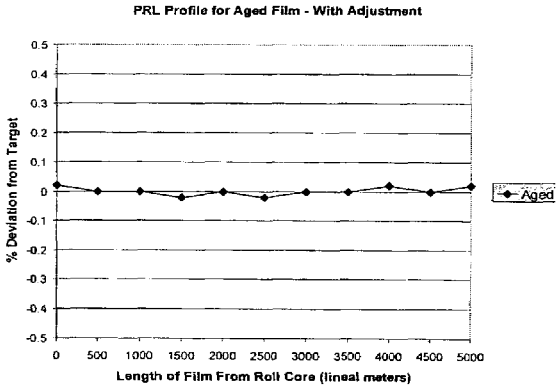
Figure 3d
Figure 3

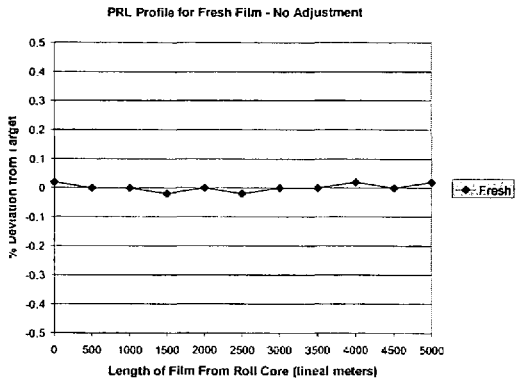
Figure 4a
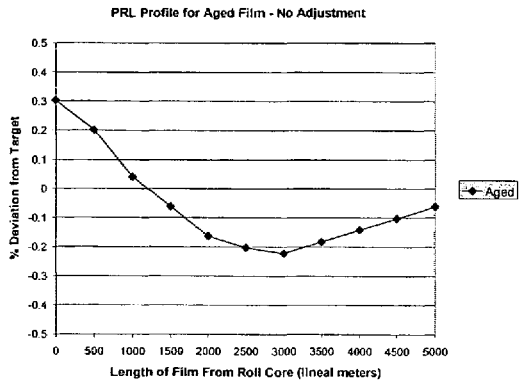
Figure 4b
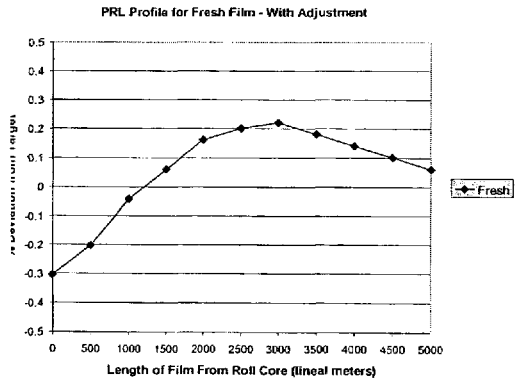
Figure 4c
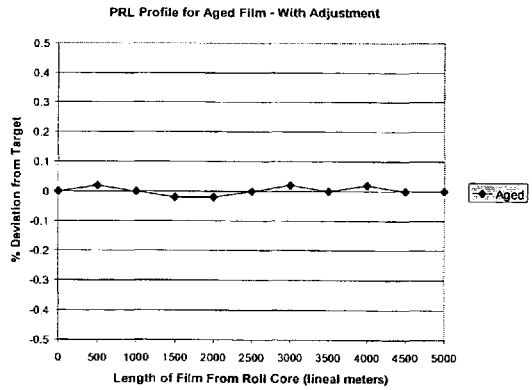
Figure 4d
Figure 4

METHOD FOR CORRECTING PRINT REPEAT LENGTH VARIABILITY IN PRINTED EXTENSIBLE MATERIALS AND PRODUCT

CROSS-REFERENCES TO RELATED APPLICATIONS

This application claims the benefit of U.S. Provisional Patent Application No. 60/586,582, filed Jul. 10, 2004, which is incorporated herein by reference.

FIELD OF THE INVENTION

This invention relates to flexographic printing on extensible substrates.

BACKGROUND OF THE INVENTION

Printing on a variety of surfaces is well known in the art. Printing has been done on paper, fabric, wood, and other surfaces for generations. Printing on newer synthetic materials, such as polymer films, is also known. Printing allows colors, graphic designs, and text to be placed on the material of interest.

Printing on polymer film and other extensible materials can present challenges, though, due to the extensible nature of the material. Extensible materials such as polymer films can stretch and deform when stressed, even if the material is not considered to be elastomeric.

For example, continuous webs such as films undergo stresses when being wound on a roll. These stresses on the web may vary depending on the depth of the web on the wound roll. For instance, material close to the roll core may experience a great deal of tension due to the force required to initially start winding the roll. The material closer to the middle of the roll depth may experience less tension as the roll is smoothly wound. The material near the outer portion of the roll may experience increased tension. Thus, as an extensible material is wound on a roll, these varying tensions can cause the material to stretch slightly to a lesser or greater extent. Some winders have the ability to adjust the winding speed and tension over the profile of the roll in order to compensate somewhat for this effect.

Another effect that extensible materials, particularly polymer films, can experience is relaxation during aging. This relaxation process is sometimes referred to as "snapback". When a film is first extruded, the polymer chains may be aligned and stressed somewhat during the extrusion process. As the film cools, and particularly as it ages for a few days, these stresses are gradually released and the film relaxes. During this relaxation, the film will tend to retract (i.e., shorten) slightly. However, because of the varying web tensions within the roll itself, varying degrees of retraction will be observed within the roll.

These two problems, winder tension variability and snapback, can cause a printed extensible materials to vary significantly in print repeat length. A pattern printed repeatedly on a strip of extensible material can be distorted by as much as 1% in length as the printed material is wound and later as it ages. This distortion, particularly if cumulative, can result in misaligned or miscut product when the printed material is later unwound for converting.

Today's consumer has come to expect high-quality, detailed graphics on products from packaging films to shrink-wrap seals to disposable hygiene products. There is thus a continuing need to improve the printing repeat-length control of polymer films in order to manufacture materials that can meet this expectation.

SUMMARY OF THE INVENTION

This present invention provides methods of printing a repeating pattern on a web of extensible material. In one embodiment, this method comprises the steps of:

a. providing a web of an extensible material;
b. determining an adjusted print repeat length profile for a repeating pattern to be printed on the web of material; and
c. printing a repeating pattern on a surface of the extensible material, the repeating pattern comprising printed indicia which is repeated along the length of the web, such that the print repeat length of the printed indicia varies along the length of the web in accordance with the adjusted print repeat length profile.

The adjusted print repeat length profile is determined such that, when the roll of printed material is subsequently unwound, the variability of the print repeat length along the length of the printed web will be less than it would be had the print repeat length not varied along the length of the web.

This method may further include the steps of measuring the actual print repeat length of the printed indicia printed on the extensible material; comparing the actual print repeat length measurement to the adjusted print repeat length profile; and controlling the printing step in response to the results of the comparing step. The measuring step may be performed automatically by a repeat length measurement device, such as an optical device (e.g., a camera capable of measuring images). Any of a variety of printing systems and devices may be used, such as a gearless, flexographic printing press.

The methods of the present invention may be performed on a variety of extensible materials, such as a polymeric film. Suitable polymeric film materials include, for example, polyolefins, polyesters, nylons, copolymers of one or more of the foregoing materials with one another or with another polymer-forming monomer, and mixtures thereof. The methods of the present invention may also be used for printing fabrics, such as nonwoven fabrics.

The method described above may further include the step of winding the extensible material into a roll after the printing step.

The present invention also provides a printed web of an extensible material produced in accordance with the methods described herein, as well as a printed sheet of extensible material cut from a web produced in accordance with the methods described herein. By way of example, a printed label may be cut from a web of extensible material which has been previously printed in accordance with the methods described herein. Similarly, a backsheet for a disposable diaper may be cut from a web of extensible material which has been previously printed in accordance with the methods described herein, and the disposable diaper then assembled in a manner known to those skilled in the art.

The present invention also provides a freshly printed web of extensible material having a repeating pattern printed thereon, the repeating pattern comprising printed indicia which is repeated along the length of the web, wherein the print repeat length of the printed indicia varies along the length of the web.

Similarly, the present invention also provides a wound and aged web of extensible material having a repeating pattern printed thereon, the repeating pattern comprising printed indicia which is repeated along the length of the web, wherein the print repeat length variability of the printed indicia is less than 0.2% (or even less than 0.1%) when the web is unwound. The printed webs of extensible material produced in accordance with the various embodiments of the present invention may include any number of repeating patterns printed thereon, such as 100 or more repeating patterns, or even 1000 or more repeating patterns printed on a single continuous web.

BRIEF DESCRIPTION OF THE DRAWINGS

The following detailed description will be more fully understood in view of the drawings in which:

FIGS. 3*a*-3*d* illustrate representative PRL profiles of an exemplary printed material without and with PRL adjustment at the press;

FIGS. 4*a*-4*d* illustrate representative PRL profiles of another exemplary printed material without and with PRL adjustment at the press;

Figure 1:
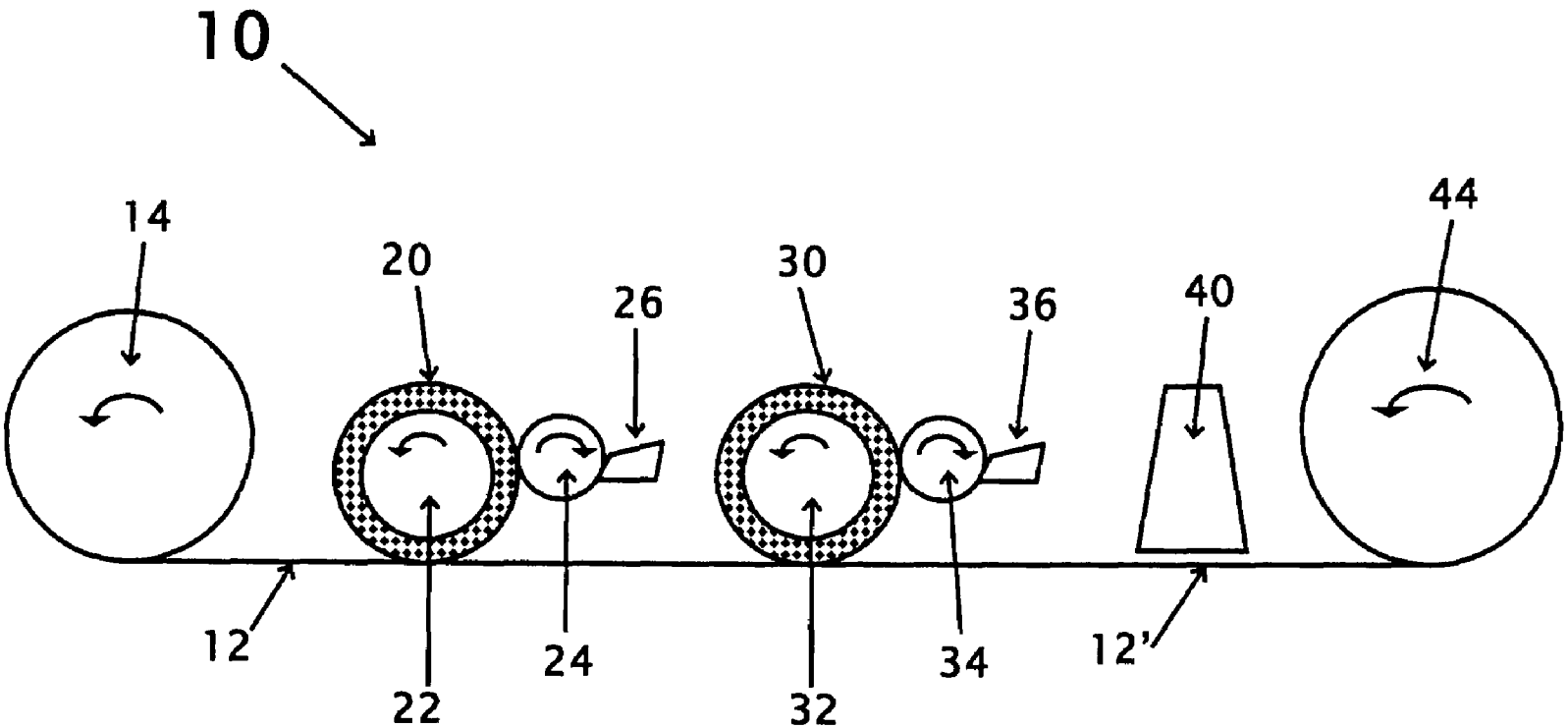
FIG. 1 is a schematic illustration of an exemplary flexographic printing system.

The embodiments set forth in the drawings are illustrative in nature and are not intended to be limiting of the invention defined by the claims. Moreover, individual features of the drawings and the invention will be more fully apparent and understood in view of the detailed description.

DETAILED DESCRIPTION

One embodiment of the present invention provides a method of compensating for distortions experienced by printed extensible materials (e.g., polymer film) during processing, such as winding stresses and snapback. Applicant has surprisingly found that these winding and aging effects are predictable for a given material composition. A target print repeat length ("PRL") profile may thus be established for a given material composition and dimension (e.g., film thickness), and the printing system can be controlled in order to adjust the print repeat length in accordance with the target PRL profile. In this fashion, the printing process may compensate for the forces previously discussed and yield a wound, aged film with little PRL variability (e.g., ±0.2% or even ±0.1%).

For the purpose of this patent application, the following terms are defined as follows:

*"Film" refers to material in a sheet-like form where the dimensions of the material in the x (length) and y (width) directions are substantially larger than the dimension in the z (thickness) direction. In general, films have a z-direction thickness in the range of about 1 μm to about 1 mm.

*"Extensible" refers to polymer materials that can be stretched at least 130% without breaking, but retract to greater than 120% of their original dimension and therefore are not elastomeric. For example, an extensible film that is 10 cm long should stretch to at least about 13 cm under a stretching force, then retract to a length greater than about 12 cm when the stretching force is removed.

*"Print repeat length" or "PRL" refers to the measured distance between identical places on two successive printed patterns on a printed material. The PRL will include both the printed pattern and any unprinted space between each printed pattern.

*"Actual print repeat length" or "actual PRL" refers to the measured PRL of a printed material.

*"Target print repeat length" or "target PRL" refers to the PRL value that is desired by the end user of the printed material.

*"Print repeat length profile" or "PRL profile" refers to a descriptive or graphical representation of the PRL over the length of a printed material containing a multiplicity of repeated printed patterns. A common way to present a PRL profile is by way of a graph. If presented as a graph, the PRL profile may be presented in a number of ways. The x-axis (independent variable) is typically the distance from the beginning of the printed material, measured in appropriate units of distance such as lineal meters. The y-axis (dependent variable) will be some value of the measured PRL at a given point on the x-axis. The dependent variable may be the actual PRL, the raw variance of the measured PRL from the target print length, the absolute value of said raw variance from the target print length, the percent variance of the measured PRL from the target print length, or other such appropriate value.

*"Freshly printed" refers to material immediately after it has been printed.

*"Aged" refers to material that has been printed and held for any interval of time longer than one second after completing the printing process.

*"Wound and aged" or "wound, aged" refers to material that has been printed and wound into a roll, then held for any interval of time longer than one second after the material has completed the winding process of that individual roll of printed material.

Flexographic printing is one of the simplest methods of mechanically printing on a continuous web of material. In flexographic printing system 10 shown in FIG. 1, the image to be printed is created on a raised impression plate 20. The impression plate is then mounted onto a roll 22. Ink is applied to the impression plate, for example with an anilox roll 24 which picks up a single color of ink from an ink containment device 26, such as a pan, and transfers the ink to the raised portions of the impression plate 20. The impression plate 20 then rotates over the material 12 (e.g., a polymer film) to be printed. If a second color is to be printed on the material 12, another impression plate 30 is mounted on roll 32. The second color of ink is picked up from pan 36 and applied by anilox roll 34 to the impression plate 30. Similarly, if three or more colors are desired, then additional printing decks comprising impression plates, mounting rolls, anilox rolls, etc. are used inline. Optionally, one or more drying units 40 may be used after each printing step or all printing steps to hasten the drying of the ink on the surface of the printed material 12'.

Originally, flexographic printing was synchronized through mechanical means. The impression plates were gear-driven by a central motor in order to synchronize the printing steps so that the colors would superimpose on one another and form a pleasing image. Setting up the synchronization was a difficult and time-consuming task requiring highly skilled press workers. It was an energy-intensive operation, due to frictional losses through the multiple gears. Also, the gears tended to wear, which would result in the gradual loss of synchronization and hence print quality.

Figure 2:
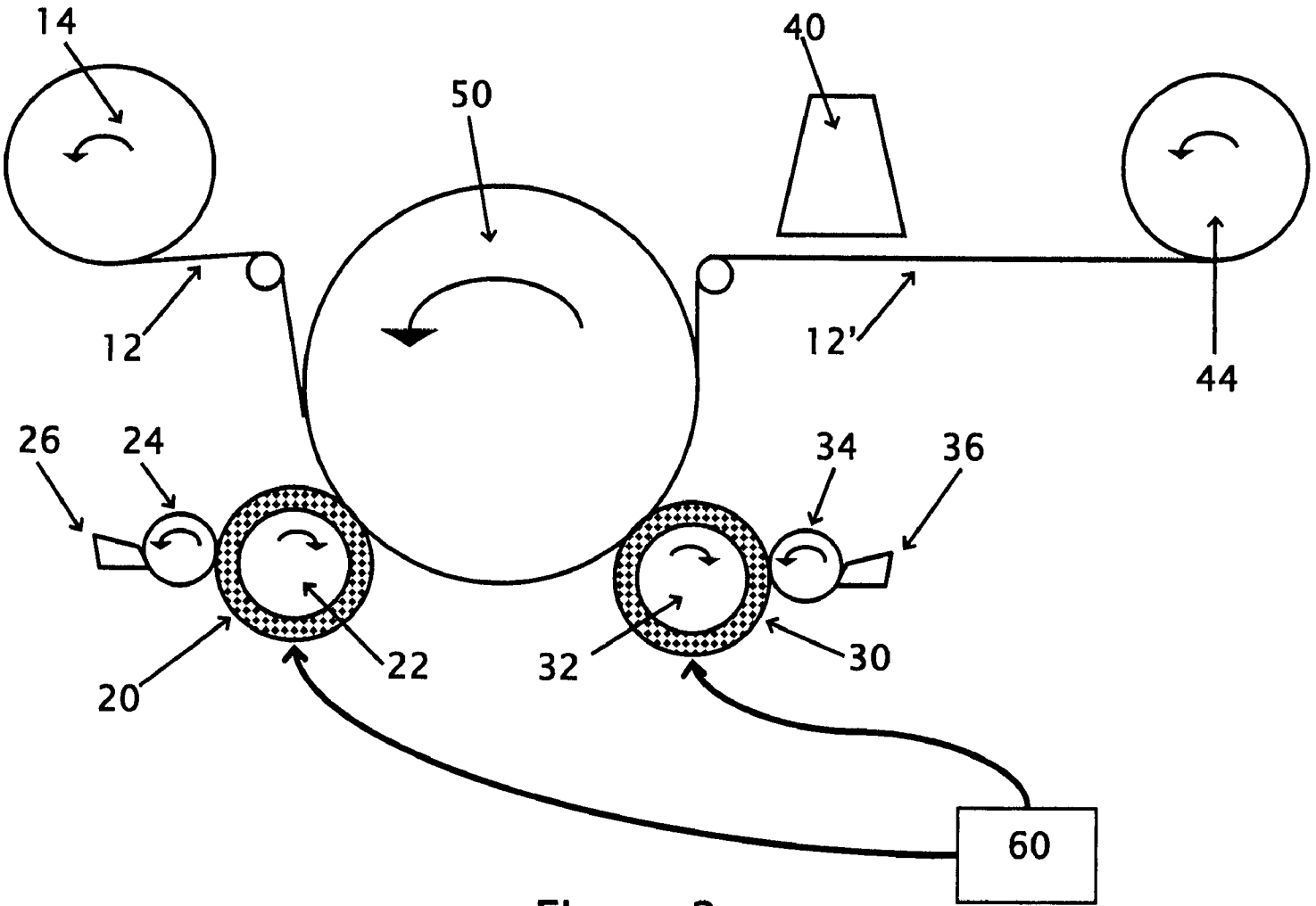
FIG. 2 is a schematic illustration of an exemplary gearless flexographic printing press.

In recent years, flexographic printing has been simplified through the development of gearless printing. FIG. 2 illustrates one example of a typical gearless flexographic printing system. In this case, the material to be printed 12 is unwound from a roll 14 and is guided by idler rolls to pass over the surface of a central impression (CI) drum 50. In the illustration of FIG. 2, ink from two printing decks (for example, two colors of ink) can be printed on the material 12. The ink of the first printing deck is held in pan 26, from which the ink is picked up by anilox roll 24 and transferred to the first impression plate 20 which is mounted on roll 22. The first impression plate 20 then prints the first ink pattern on the material 12. The material 12 is then carried by the CI drum 50 to the second printing deck, where the process is repeated by a second impression plate 30 on mounting roll 32 receiving ink from an ink pan 36 via an anilox roll 34. Additional printing decks can also be installed around the CI drum 50, as desired. Once the printing is completed, the printed material 12' may then be treated by a drying unit 40 to hasten the drying of the printed inks and then wound into a roll 44.

In a gearless printing press, the rolls 22 and 32 on which the impression plates are mounted may be independently driven, such as by servo motors controlled by a controller 60 in order to maintain high registration accuracy. The gearless press is more energy efficient, and it experiences no mechanical wear to the drive components. Because of gearless printing presses and other developments, flexographic printing control has improved. Flexographic printing now rivals rotogravure printing in the precision and detail that can be obtained.

These improvements in flexographic printing have not solved another problem, though. This is the problem of print repeat length variability. When printing on an extensible material, such as a polymer film, the size of the printed pattern and the distance between repeated patterns can be closely controlled. However, after the printed extensible material is wound into a roll and stored for a period of time, at least two forces come into play that cause the extensible material to stretch or retract to varying degrees. This stretching or retraction results in a significant change in the distance between repeated printed elements. The change in the distance between repeated printed elements is problematic when the printed film is later cut to form various products. In other words, although the print repeat length of the freshly printed film may match (or closely match) the target print repeat length with little or no variability, when the end-user later attempts to unwind and cut a roll of the printed film, the end-user will discover that the print repeat length has changed. Not only will the print repeat lengths not match the target, there will be considerable variability in print repeat length throughout the roll.

The first of the two forces which causes changes in print repeat length after winding and aging is known as "snap-back". This is a well-known effect in the printing of extensible material. For example, when an extensible polymer film is freshly extruded, the polymer molecule chains are stretched and roughly aligned with the direction of the extrusion flow. As the material ages, though, the polymer molecules slowly relax and retract, resulting in a small but predictable shortening of the film. Similarly, aged film will experience some stretching when it goes through the printing process. After printing, the material will "snap back" from this printer-induced stretching as it ages. When fresh or aged film is printed, the press operator knows that some snapback will occur. Accordingly, the press will be set to print a certain PRL with the anticipation that a given amount of snapback will occur. For instance, if the desired PRL is 300 mm, the press operator may actually set the PRL to 304 mm, in the anticipation that the material will experience 4 mm of snapback.

The second force in play, though, is the varying amount of tension experienced by an extensible material when wound into a roll. It is known that continuous webs undergo stresses when being wound. These stresses on the web will vary depending on the depth of the web on the wound roll. For instance, material close to the roll core may experience a great deal of tension due to the force required to initially start winding the roll. The material closer to the middle of the roll depth may experience less tension as the roll is smoothly wound. The material near the outer portion of the roll may also experience increased tension. If the web is an extensible material such as a polymer film, these varying tensions can cause the material to snapback to a lesser or greater extent, or even to stretch a bit. While winders are designed with the ability to adjust the winding speed and tension over the profile of the roll in order to compensate somewhat for the variable tensions the wound film may experience, they do not alleviate the problem entirely.

Prior to printing, whether an extensible material experiences snapback or stretching due to these forces is usually immaterial. After printing, however, these forces can cause the PRL of the printed extensible material to vary significantly. When the material is printed, the snapback effect is countered by the winding tension effect. Material near the core or outer edge of the film is under higher tension, and so the snapback experienced there is less. In the example above, the fresh film is printed with a PRL of 304 mm, anticipating snapback to 300 mm as the film ages. At the core and outer layers of the roll, where the winding tension is high, the material may snap back less, e.g. to only 302 mm, or even stretch slightly, e.g. to 306 mm. The material wound at the center depth of the roll, however, experiences less winding tension, and it is able to snap back to the full 300 mm. Hence, the aged printed material will have an actual PRL that varies from 306 to 300 mm.

For materials that are printed with a random pattern, this variability in the PRL is usually unnoticed or insignificant. However, for printed material where printed elements such as lettering and graphics must be precisely located for the end use (e.g., shrink-wrap labels), variability in the PRL can cause problems. When manufacturing the end product, this PRL variability can accumulate, resulting in the printed material being cut off-center or even cut into the pattern of the printing.

In order to compensate for PRL variability, a print shop may have to purchase excess material to ensure the correct number of items is printed. However, if the PRL variability can be controlled, the print shop can reduce the excess material purchased, and thereby save this wasted expense.

The present invention provides methods to correct for the variability in PRL when the print length must be precisely reproducible. Applicant has discovered that PRL variability is predictable for a given film composition and degree of aging. Once the PRL profile of a wound roll is known, the printing press system can be controlled to adjust the PRL, depending on the expected position of the printed extensible material on the roll, in order to yield a wound, aged film with reduced PRL variability. In some embodiments, PRL variability may be reduced to ±0.2%, or even ±0.1%.

FIG. 3 depicts exemplary PRL profile graphs of extensible films printed without and with the methods of the present invention. After printing, the extensible film is wound onto a core (e.g., a cylindrical tube) by a winding device (i.e., a winder). In the graphs of FIG. 3, the x-axis represents the measured distance of printed material in lineal meters. The material that is first printed and wound next to the core of the roll is at 0 meters on this axis. Moving to the right on the x-axis represents additional material that is printed and wound on the roll, until one reaches the outside of the wound roll (i.e., the outermost portion of the wound roll of printed film). For the purposes of these graphs, the end (outside) of the roll is represented as being at 5000 lineal meters. In these graphs, the y-axis represents the percent variance of the actual print repeat length at that point in the material from the target print repeat length (i.e., the print repeat length desired by the end user of the roll of printed extensible material).

FIG. 3*a* is the PRL profile of a freshly printed extensible material with a constant target repeat length, prior to being wound in a roll. This is the typical goal for a printed material, and the measured print length varies little from the target. However, once this exemplary printed extensible material is wound in a roll and aged, even for a brief period of time, the PRL profile will begin to change due to the snapback and tension forces discussed previously. FIG. 3*b* depicts one possible PRL profile that might be found in wound and aged material. It will be noted from FIG. 3*b* that the greatest positive deviation from the target PRL occurs at the core of the roll, while the greatest negative deviation occurs at a point located between the core and the outermost surface of the roll.

In contrast, FIG. 3*c* illustrates how the PRL profile may be adjusted with the present invention to compensate for the effects seen in FIG. 3*b*. In this case, instead of being held constant as in FIG. 3*a*, the PRL of the freshly printed material (i.e., prior to winding and no aging) is deliberately shortened or lengthened during the printing process to yield a non-constant PRL on the freshly-printed material. FIG. 3*d* illustrates the PRL profile of the wound, aged material of FIG. 3*c*. As can be seen, the forces experienced by the wound material have altered the PRL profile, but now the profile shows an essentially constant repeat length since the PRL was adjusted during printing in order to account for changes in PRL during the subsequent winding and aging.

FIG. 4 illustrates another exemplary type of extensible material with a different PRL profile. Again, FIG. 4*a* shows the PRL profile of freshly printed material, and FIG. 4*b* shows the PRL profile after the printed material is wound and aged. This profile differs from FIG. 3*b* because of the composition, structure, or other aspect of the exemplary materials. However, once the profile in FIG. 4*b* is known or estimated, the present invention can be used to correct for this profile. FIG. 4*c* illustrates the adjusted PRL profile for a freshly-printed material that is intended to compensate for the PRL profile of 4*b*. After being wound and aged, the printed material is found to have the PRL profile illustrated in 4*d*.

Applicant believes that the PRL profile will depend on the composition and structure of the extensible material being printed. For example, the PRL profile of a polyethylene film will differ from the PRL profile of a nylon film of similar thickness. The degree and reproducibility of the PRL profile over time and roll-depth position may be measured or estimated for a given composition or structure of the extensible material to be printed.

Surprisingly, applicant has also discovered that the PRL profile of a wound roll of a given extensible material will change in a predictable, repeatable manner. Also surprisingly, this PRL profile change occurs in a repeatable manner as the extensible material ages. In addition, applicant has unexpectedly discovered that the overall shape of the PRL profile remains essentially constant for a given extensible material that has aged for different time periods.

Figure 5:
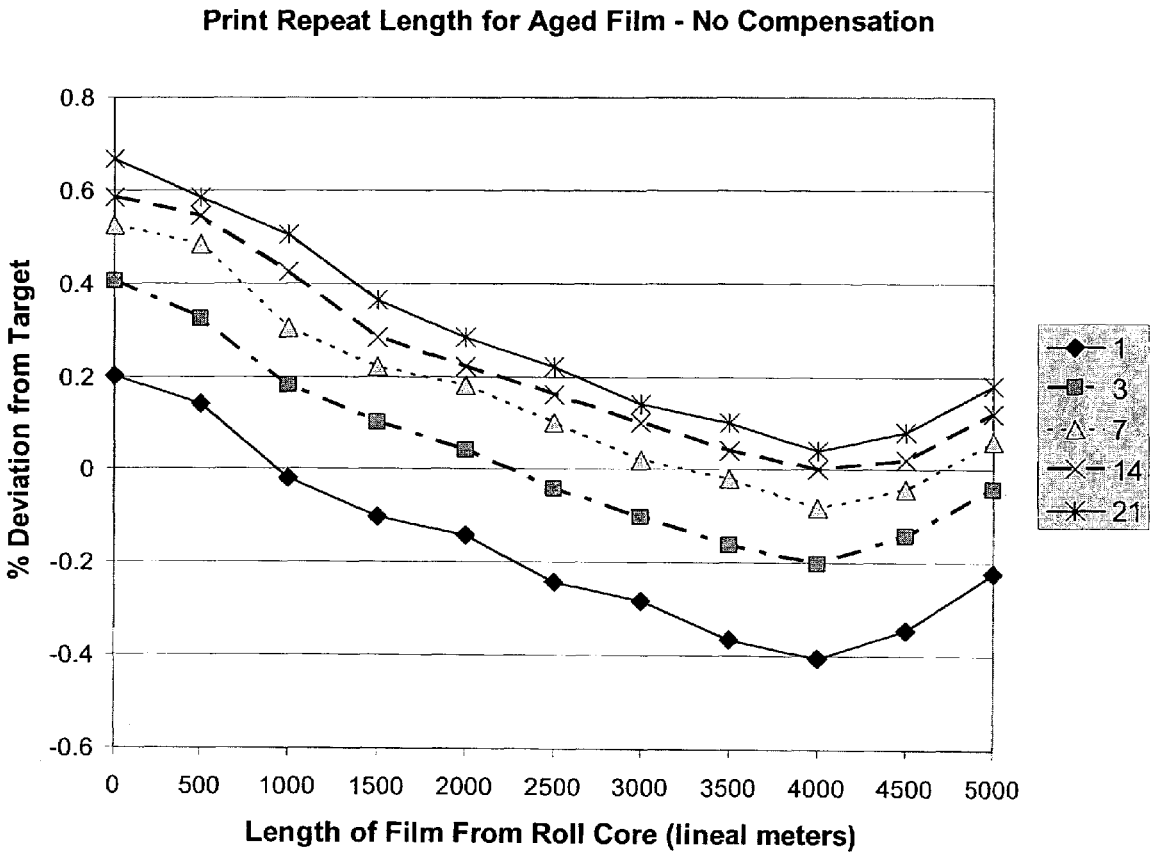
FIG. 5 illustrates a representative PRL profile of an exemplary printed material without PRL adjustment, aged for different time intervals.

As shown in FIG. 5, the PRL profile curves of an exemplary extensible material shift up or down the y-axis relative to the target value as the material ages. Unexpectedly, though, the overall shapes of these PRL profile curves remain essentially the same. This means that the adjusted PRL profile (e.g, FIGS. 3*c* and 4*c*) will also have a constant shape for a given extensible material. No matter how long the extensible material ages in the wound roll, the PRL adjustment initially made during printing should provide acceptable correction to the PRL profile of the wound material. The resulting PRL of the aged material may vary a fraction of a percent from the target print length, but the PRL will remain essentially constant throughout the roll (i.e., little or no PRL variability). A converter (i.e., and end-user) can make a single adjustment for a small variance from the target print length, and the printed material can be easily converted at the adjusted but essentially constant repeat length.

The aged, unadjusted PRL profile (e.g., FIGS. 3*b* and 4*b*) may be established by measurement and/or estimation for a given extensible material (composition and configuration, such as length, width and thickness) and for given equipment and operating parameters (e.g., type and size of winder, winding tension, etc.). From this aged, unadjusted PRL profile, an adjusted PRL profile (FIGS. 3*c* and 4*c*) for freshly printed extensible material may be determined (measured and/or estimated) for the same or similar extensible material, equipment and operating parameters. Thereafter, extensible material may be printed in accordance with the adjusted PRL profile—i.e., the desired print repeat length at a given location along the length of the web may be determined using the adjusted PRL profile and hence the PRL will vary along the length of the web in accordance with the adjusted PRL profile. It will also be noted that the adjusted PRL profile will generally be the inverse of the unadjusted PRL profile for wound and aged extensible material (FIGS. 3*b* and 4*b*).

Once the adjusted PRL profile has been established, by measurement and/or estimation, PRL variability can be reduced simply by printing the extensible material in accordance with this profile (i.e., the PRL closely matching the PRL indicated in the adjusted PRL profile). By way of example, in the exemplary embodiment of FIG. 3, the PRL for the freshly printed material (i.e., the PRL measured immediately after printing and prior to winding) at the beginning of the web would be about 0.4% less than the target PRL. At the end of the web (i.e., the outermost portion of the web when it is ultimately wound into a roll), the PRL would be about 0.2% greater than the target PRL.

The PRL of the freshly printed extensible material may be controlled by adjusting the print length during printing, yielding a freshly-printed film with a PRL that varies over the multiple images on the length of the material. After the printed film is wound and aged, the snapback and winder tension forces previously discussed will counteract the variability in the initially printed images.

By way of example, a gearless press may be controlled to variably adjust the PRL during the printing process in the manner described previously. The adjusted PRL profile may be input to the controller 60 in order to control PRL in accordance with the adjusted PRL profile over the length of the web. The PRL adjustment is based on the anticipated roll position of that section of film once it is wound onto a roll. This variable adjustment is designed to anticipate and correct for the anticipated snapback or tension that will occur at that location in the wound roll.

The system may also include one or more feedback control systems in order to ensure that the PRL corresponds to that indicated by the adjusted PRL profile. As shown in the exemplary gearless printing system of FIG. 6, a repeat-length monitor (RLM) 70, such as a camera or other sensing device (such as an optical measuring device), may be provided in order to monitor the print length on the material after printing (and prior to winding). The RLM 70 or a computing device associated therewith, such as computer 75, measures the PRL of each printed image as it passes the device. This information can be stored in a computer 75 or other recording device and reviewed by the press operators to verify the consistency of the PRL throughout the roll.

Figure 6:
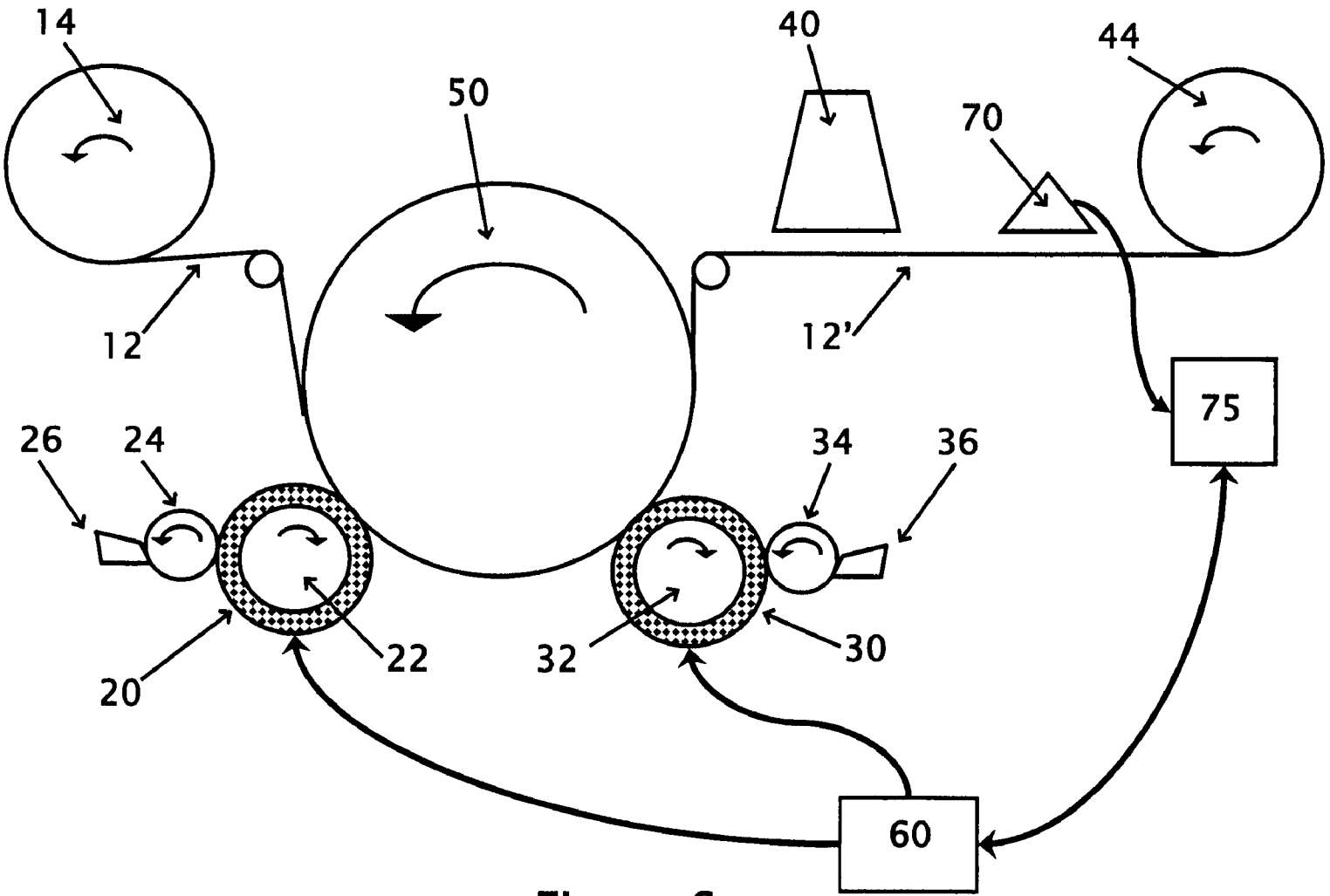
FIG. 6 is a schematic illustration of one embodiment of a flexographic printing system and process according to the present invention.

As illustrated in FIG. 6, the RLM 70 also can provide feedback to the press controller 60 (either directly or/and through computer 75) for on-the-fly adjustments to the press during the print run. If the PRL begins to drift from the repeat length value established by the adjusted PRL profile, the RLM computer 75 can note the drift and signal the press controller 60 to adjust the print repeat length accordingly.

As was discussed previously for FIG. 2, in a gearless press the rolls 22 and 32 on which the impression plates are mounted are driven independently via servos which are controlled by the press controller 60. Because these rolls are driven independently, the controller 60 can vary the rotation of these rolls independently of the rotation of the CI drum 50. This independent rotation speed of the mounting rolls 22 and 32 allows the impression plates 20 and 30 to be run slightly faster or slower than the CI drum 50. By varying the impression plate speed, the printed image can be made slightly larger (slower plate speed) or smaller (faster plate speed) than the image would be if the plate speeds and CI drum speeds were identical. The PRL of the image can be varied as much as 1% at the press with little or no degradation in print quality.

In one embodiment of the present invention, the RLM computer 75 can be programmed to proactively adjust the PRL of the printed material based on the adjusted PRL profile so that, after the printed material is wound into a roll and ages, the PRL returns to a near-constant target value (i.e., little or no variability in PRL when the printed roll is later unwound for conversion into products). If an exemplary printed extensible material is known to exhibit the PRL profile of 3*b* upon winding and aging, for example, the RLM computer 75 can be programmed with the adjusted PRL profile of FIG. 3*c*. As the RLM 70 monitors the PRL of the freshly-printed material, the computer 75 calculates the appropriate print length adjustment, taking into account both the programmed PRL profile 3*c* and any PRL drift detected by the RLM 70. This calculated PRL adjustment is sent to the press controller 60 so that on-the-fly adjustments to the rotation speeds of rolls 22 and 32 can be made. This feedback control allows the freshly printed material to have the PRL profile shown in FIG. 3*c*. After the material is wound and aged, the PRL profile of the material will be that of 3*d*, with a near-constant print repeat length.

Similarly, for a printed extensible material with a PRL profile like that shown in FIG. 4*b*, the RLM computer 75 can be programmed to adjust the print controller 60 to yield freshly-printed material with a adjusted PRL profile like that shown in FIG. 4*c*. After the material is wound and aged, the PRL profile will be that of 4*d*. In a similar manner, printed extensible material with PRL profiles of other shapes can be adjusted by the present invention to compensate for the forces experienced in the wound roll and yield PRL profiles with near-constant print repeat lengths throughout the length of the rolled material.

As an alternative to controlling the PRL by adjusting the rotational speed of the rolls in which the impression plates are mounted, or in addition thereto, the tension applied to the extensible material in the printing zone may be adjusted in a manner known to those skilled in the art. For example, if the tension in the extensible material is increased in the region adjacent the impression plates 20 and 30, PRL will be reduced. Likewise, if the tension in the printing zone is decreased, PRL will be increased. In the same manner as described above and shown in FIG. 6, the tension of the extensible material in the printing zone may be adjusted along the length of the material so that the PRL of the freshly printed material corresponds to that indicated by the adjusted PRL profile. Feedback control, as described previously, may also be used to further ensure that the PRL corresponds to that indicated by the adjusted PRL profile. After winding and aging, the PRL of the printed extensible material will change due to the forces of tension and snapback, leading to a PRL profile as shown in FIGS. 3*d* or 4*d* for the aged material.

After printing, winding and aging, the printed roll of extensible material will typically be unwound and cut into individual sheets by the end-user for conversion into a final product. Such final products include, for example, a label, particularly a shrink-wrap label. The individual cut printed sheets may also be used in the manufacture of packaging materials, garments or even personal hygiene products such as diapers (e.g., a printed backsheet for a disposable diaper), a training pants, sanitary napkins, pantiliners and garments.

The present invention also provides a printed web of extensible material (e.g., 12' in FIG. 6) having a repeating pattern printed thereon, wherein the print repeat length is varied in a controlled manner over the length of the freshly printed material. The print repeat length for the repeating printed pattern can be measured and plotted on a print repeat length profile, and the profile will typically comprise a smooth curve or a curved line (e.g., FIGS. 3*c* and 4*c*).

The following examples are designed to illustrate particular embodiments of the present invention.

EXAMPLE 1

A polymer film composed of approximately 47% LLDPE, 4% LDPE, 45% ground calcium carbonate, and 4% minor ingredients (process aids, colorant, and antioxidant) is cast-extruded into an embossed film. The film is approximately 2 mils thick. The fresh film is printed with a standard, repeating print pattern at a PRL in the range of 300 to 600 mm. The snapback for this material is anticipated to be 1% of the given PRL. The printed material is then slit and wound into rolls containing approximately 10,000 lineal meters of film. The PRL of the freshly extruded and printed film is measured. The film is then set aside to age for predetermined intervals over several weeks.

Figure 7:
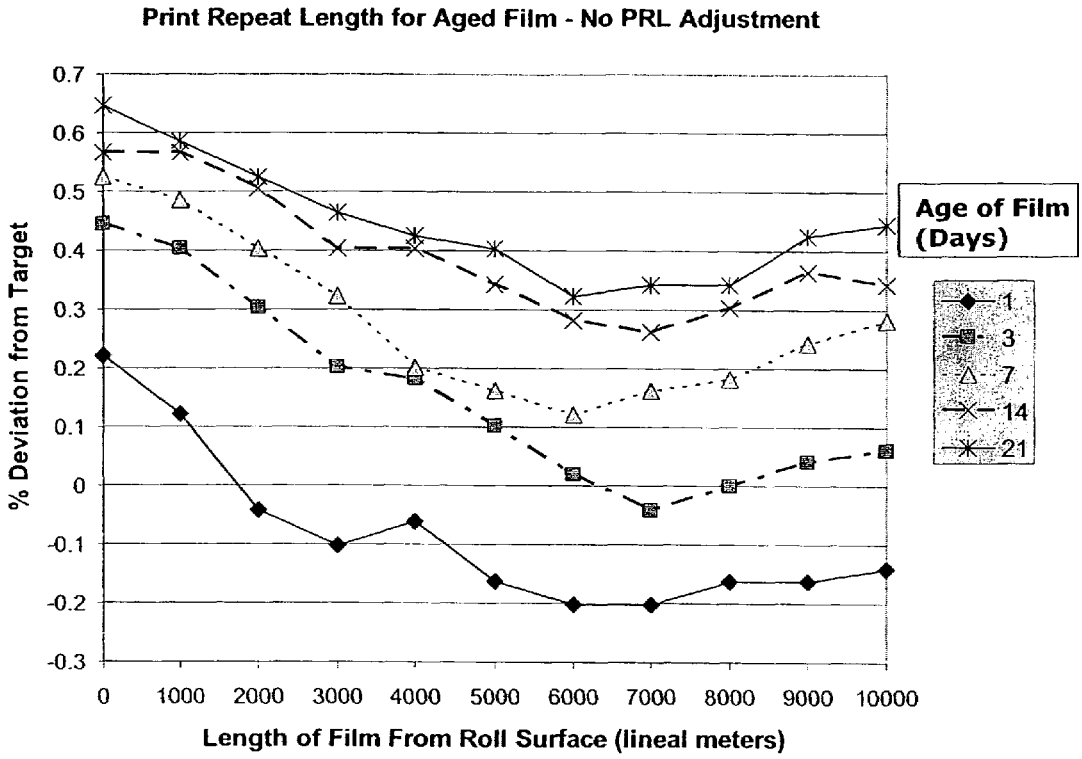
FIG. 7 depicts the PRL variability for an exemplary aged printed film with no compensation.

After aging for predetermined intervals, the film is unwound, and the PRL of the aged material is measured. The PRL variability is plotted at a given age for the film for the position on the roll in lineal meters, where 0 is the outer surface of the roll and 10,000 is the core of the roll. The PRL variability of the aged film is shown in FIG. 7.

EXAMPLE 2

A polymer film as described in Example 1 is prepared. The fresh film is printed with a standard print pattern at a PRL in the range of 300 to 600 mm. However, the tension of the film in the printing zone is controlled to compensate for the PRL variability noted in Experiment 1. The film is then slit and wound as in Example 1.

Figure 8:
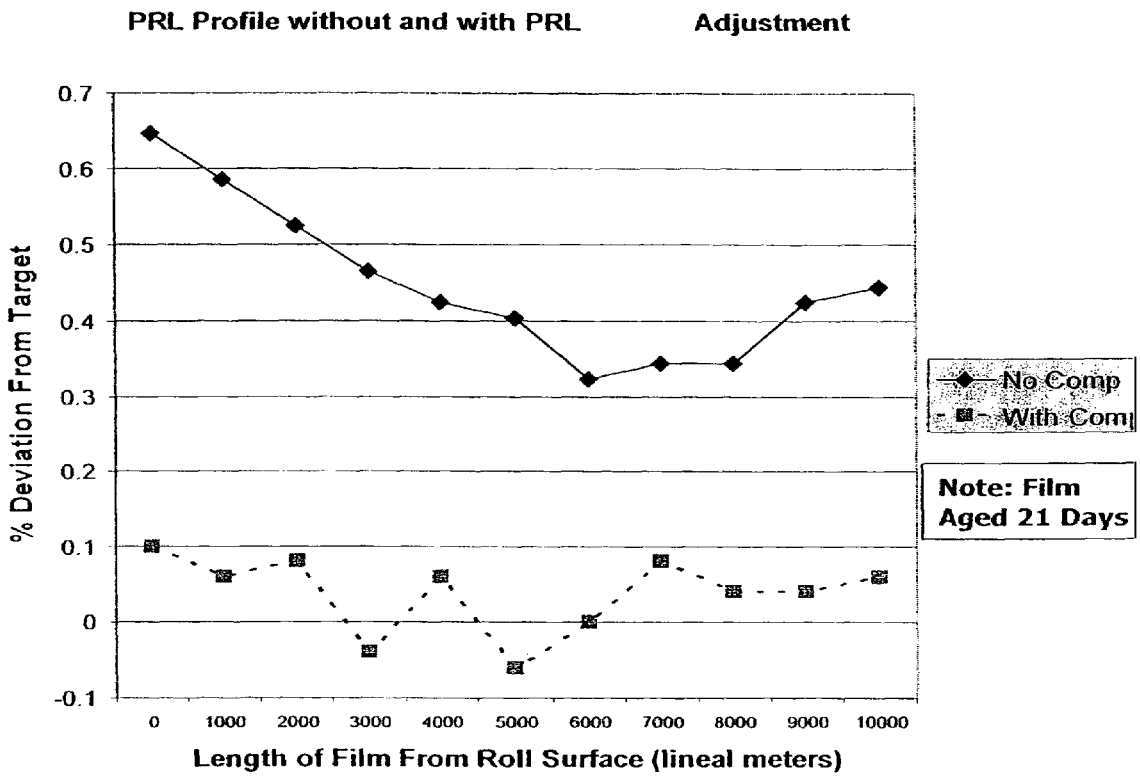
FIG. 8 depicts the PRL variability for an exemplary aged printed film after tension-control compensation at the winder.

After aging for 21 days, the film is unwound and the PRL of the aged material is measured. The PRL variability of the aged film is plotted for the position on the roll, and shown in FIG. 8. As can be seen, the PRL variability is greatly reduced and the film has an essentially constant PRL near the target value.

EXAMPLE 3

A polymer film as described in Example 1 is prepared. The fresh film is printed with a standard print pattern at a PRL in the range of 300 to 600 mm. However, the RLM computer is programmed to adjust the press controller to vary the PRL of the freshly printed film to compensate for the PRL variability noted in Experiment 1. The film is then slit and wound as in Example 1.

Figure 9:
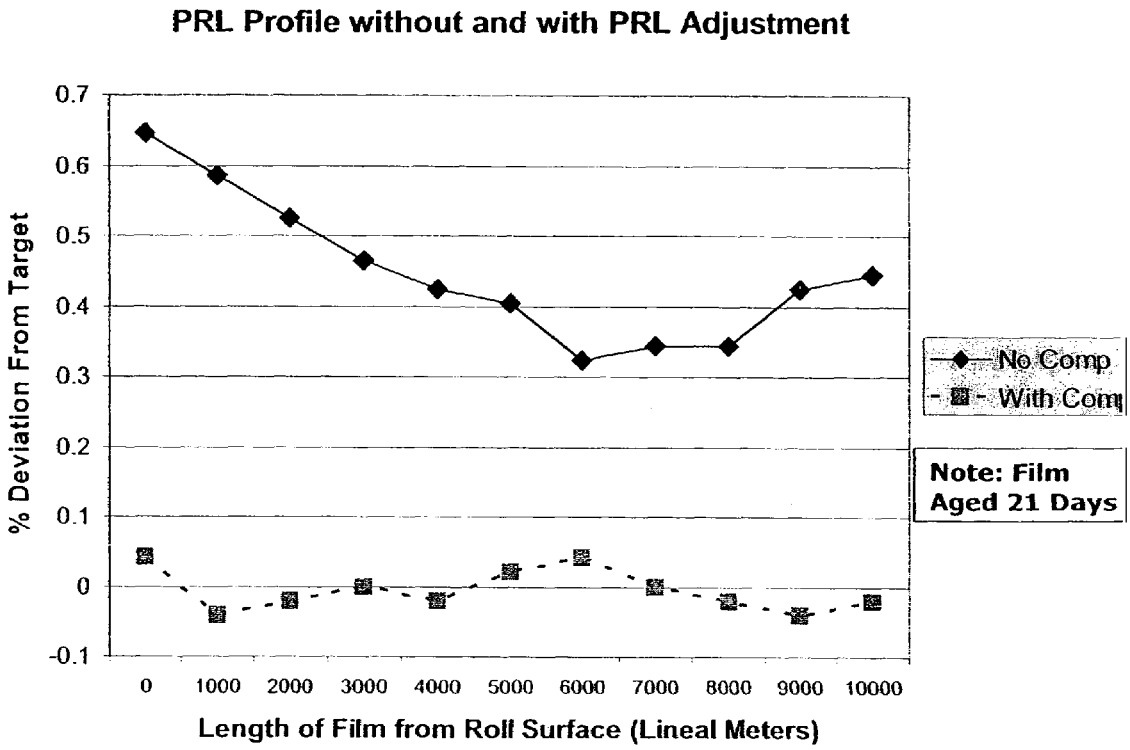
FIG. 9 depicts the PRL variability for an exemplary aged printed film after print-length compensation at the gearless press.
Figure 10:
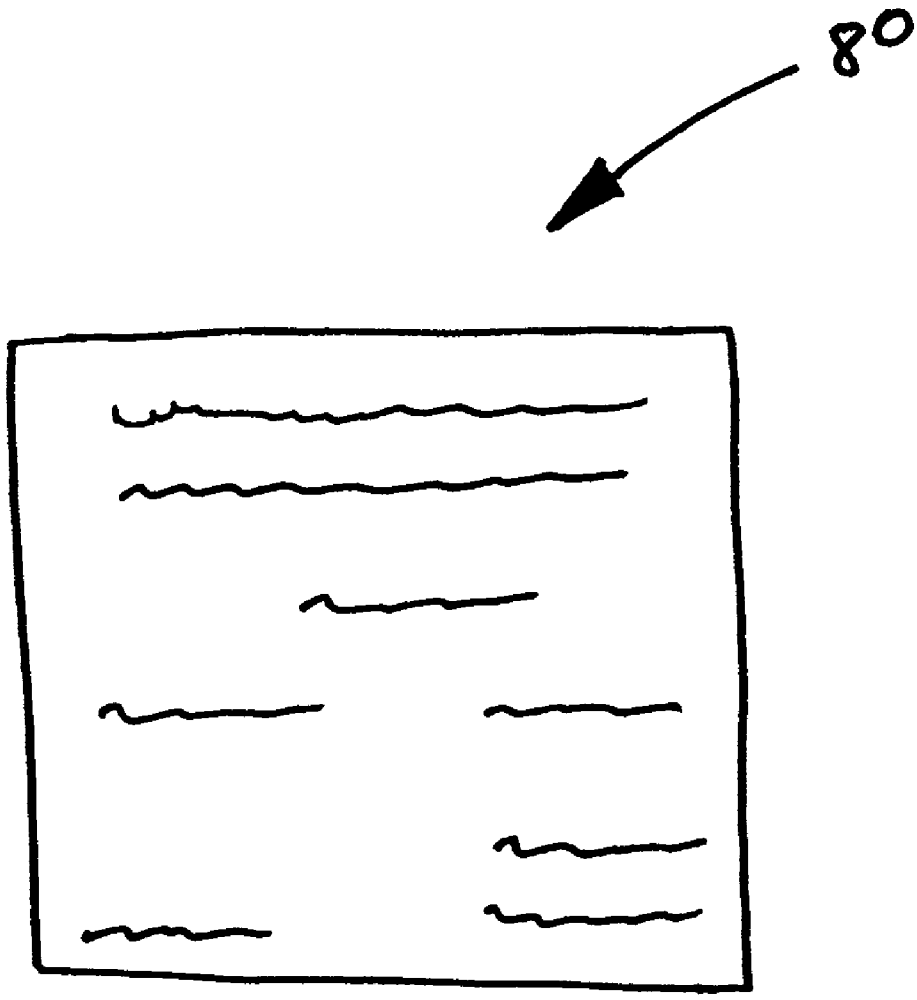
FIG. 10 is a schematic illustration of a printed label 80 produced in accordance with the present invention (i.e., by cutting the label from a printed web of extensible material)
Figure 11:
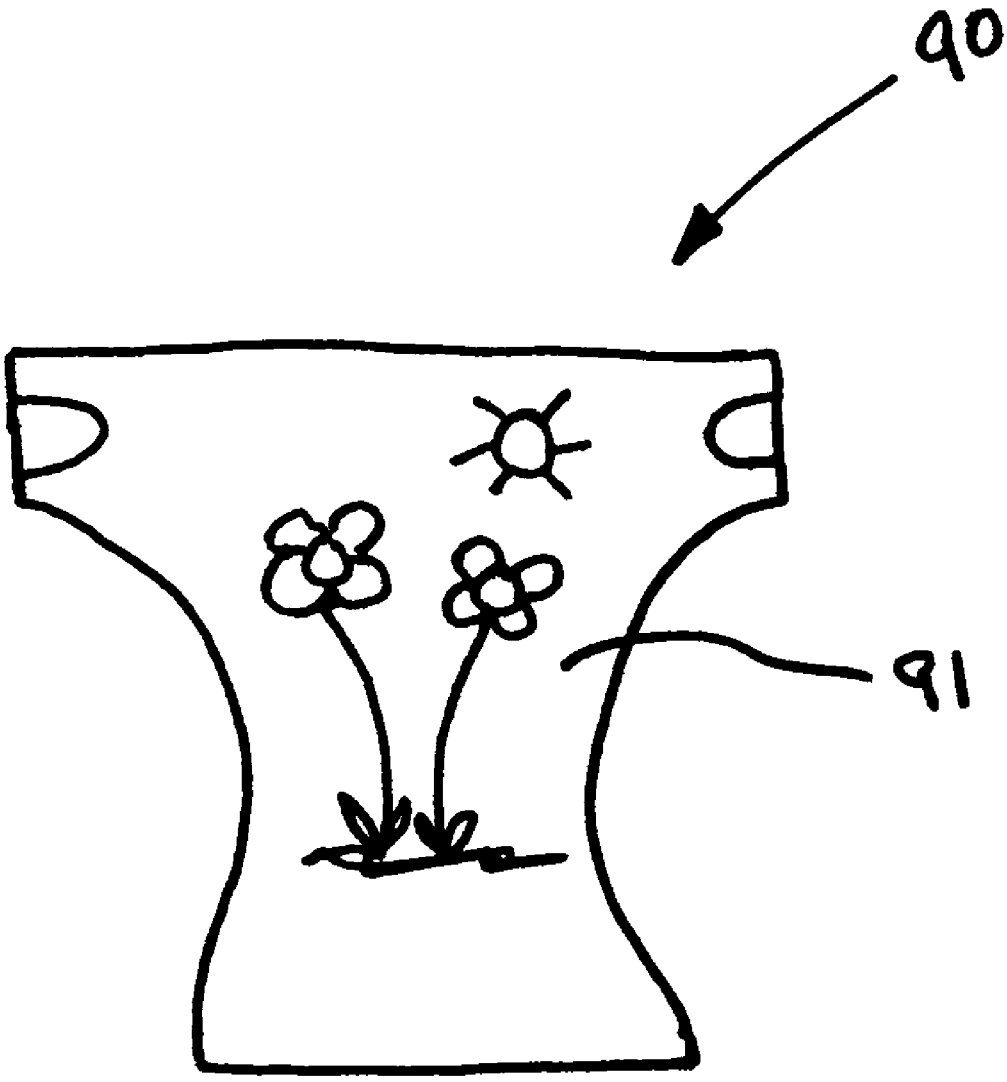
FIG. 11 is a schematic bottom plan view of a disposable diaper 90 which includes a backsheet 91 produced in accordance with the present invention (i.e., by cutting the backsheet from a printed web of extensible material).

After aging for 21 days, the film is unwound and the PRL of the aged material is measured. The PRL variability of the film is plotted for the aged roll, and shown in FIG. 9. As can be seen, the PRL variability is greatly reduced and the film has an essentially constant PRL near the target value after the PRL adjustment was applied at the press to the freshly printed film.

While the invention has been described in detail, including specific embodiments thereof, it will be appreciated by those skilled in the art that other embodiments including variations and equivalents can be conceived. Accordingly, the scope of the present invention is that of the appended claims and any equivalents thereto.

What is claimed is:

1. A method of printing a repeating pattern on a web of an extensible material, comprising:

a. providing a web of an extensible material;

b. determining an adjusted print repeat length profile for a repeating pattern to be printed on said web of extensible material, wherein said adjusted print repeat length profile is utilized to correct anticipated snapback or tension that will occur at locations along a length of said web of extensible material when wound in a roll; and c. printing said repeating pattern on a surface of said web of extensible material, said repeating pattern comprising printed indicia which is repeated along the length of said web, such that a print repeat length of said printed indicia varies along the length of said web in accordance with said adjusted print repeat length profile.

2. The method of claim 1, further comprising the steps of:

d. measuring the actual print repeat length of said printed indicia printed on said extensible material;

e. comparing the actual print repeat length measurement to said adjusted print repeat length profile; and f. controlling said printing step in response to the results of said comparing step.

3. The method of claim 2 wherein said measuring step is performed automatically by a repeat length measurement device.

4. The method of claim 3 wherein said repeat length monitoring device comprises an optical device.

5. The method of claim 1 wherein said printing step is performed by a gearless printing press.

6. The method of claim 1 wherein said extensible material is a film comprising a polymer material.

7. The method of claim 6, wherein said polymer material is selected from the group consisting of: polyolefins, polyesters, nylons, copolymers of one or more of the foregoing materials with one another or with another polymer-forming monomer, and mixtures thereof.

8. The method of claim 1, wherein said extensible material is a fabric.

9. The method of claim 8, wherein said fabric is a non-woven fabric.

10. The method of claim 1, further comprising the step of winding said extensible material into a roll after said printing step.

11. The method of claim 10, wherein said adjusted print repeat length profile is determined such that, when the roll of printed material is subsequently unwound, the variability of the print repeat length along the length of the printed web will be less than it would be had said print repeat length not varied along the length of said web.

* * * * *

UNITED STATES PATENT AND TRADEMARK OFFICE

CERTIFICATE OF CORRECTION

PATENT NO. : 7,584,699 B2
APPLICATION NO. : 11/179040
DATED : September 8, 2009
INVENTOR(S) : Jerry W. Ford It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 782 days.

Signed and Sealed this

Fourteenth Day of September, 2010

David J. Kappos

David J. Kappos
*Director of the United States Patent and Trademark Office*